US005803551A

United States Patent [19]

McCarthy

[11] Patent Number: 5,803,551

[45] Date of Patent: Sep. 8, 1998

[54] METHOD APPARATUS AND CARTRIDGE FOR NON-EXPLOSIVE ROCK FRAGMENTATION

[75] Inventor: Donald E. McCarthy, Littleton, Colo.

[73] Assignee: First National Corporation, Belize City, Belize

[21] Appl. No.: 713,618

[22] Filed: Sep. 13, 1996

Related U.S. Application Data

[63] Continuation-in-part of Ser. No. 529,063, Sep. 15, 1995, Pat. No. 5,611,605.

[51] Int. Cl.[6] ..... E21C 37/14

[52] U.S. Cl. ..... 299/13; 299/16

[58] Field of Search ..... 299/13, 16; 102/202.3, 102/313

[56] References Cited

U.S. PATENT DOCUMENTS

| | | | |
|---|---|---|---|
| 3,623,771 | 11/1971 | Sosnowicz et al. | 299/12 |
| 3,848,927 | 11/1974 | Livingston | 299/13 |
| 3,988,037 | 10/1976 | Denisart et al. | 299/16 |
| 4,040,355 | 8/1977 | Hopler, Jr. | 102/22 |
| 4,123,108 | 10/1978 | Lavon | 299/16 |
| 4,141,592 | 2/1979 | Lavon | 299/16 |
| 4,204,715 | 5/1980 | Lavon | 299/16 |
| 4,266,827 | 5/1981 | Cheney | 299/20 |
| 4,289,275 | 9/1981 | Lavon | 239/101 |
| 4,449,754 | 5/1984 | Orlov et al. | 299/21 |
| 4,501,199 | 2/1985 | Mashimo et al. | 102/313 |
| 4,508,035 | 4/1985 | Mashimo et al. | 102/313 |
| 4,582,147 | 4/1986 | Dardick | 175/1 |
| 4,669,783 | 6/1987 | Kolle | 299/16 |
| 4,900,092 | 2/1990 | Van Der Westhuizen | 299/13 |
| 5,000,516 | 3/1991 | Kolle et al. | 299/16 |
| 5,098,163 | 3/1992 | Young, III | 299/13 |
| 5,308,149 | 5/1994 | Watson et al. | 299/13 |

*Primary Examiner*—Frank Tsay
*Attorney, Agent, or Firm*—Aquilino & Welsh

[57] ABSTRACT

A non-explosive rock breaking method is disclosed. The method is accomplished by first drilling a hole into a rock. A charging system is then positioned adjacent the hole and a propellant cartridge is inserted within the charging system. The propellant cartridge contains a propellant and means for igniting the propellant. Finally, the propellant cartridge is forced through the charging system and into the hole to ignite the propellant. A cartridge and apparatus for performing the method are also disclosed.

21 Claims, 10 Drawing Sheets

METHOD APPARATUS AND CARTRIDGE FOR NON-EXPLOSIVE ROCK FRAGMENTATION

This is a Continuation-in-Part of Ser. No. 08/529,063, filed Sep. 15, 1995. now U.S. Pat. No. 5,611,605.

BACKGROUND OF THE INVENTION

1. Field of the Invention

The invention relates to mechanized rock breaking techniques. More particularly, the invention relates to methods, apparatuses and cartridges for non-explosive rock fragmentation.

2. Description of the Prior Art

Oversized rocks and boulders are a substantial worldwide problem in underground mining, surface mining, open pits and quarries, earth moving and allied construction works, and civil demolition projects. For the purposes of the following specification, the terms rock(s) and boulder(s) are considered to be interchangeable, and the use of either term should not be construed as limiting the disclosed invention in any way.

Ideal rock fragmentation processes produce a cost effective and optimum particle size distribution. This requires the production of rock fragments having an average particle size as small as possible to lessen further handling within the mine transportation system and to minimize the necessity for subsequent size reduction. Underground mining operations often produce oversized boulders that are too large to flow naturally from the ore draw points and ore passes. Additionally, the oversized boulders may be too large for loading and transport equipment. The boulders may also be too large for primary crushing and must be further reduced in size before they are crushed.

These large boulders are often created by inaccurate drilling of blast holes for explosives, misfiring of explosives, using the wrong explosives, and incorrect planning of hole patterns. The large boulders must be reduced in size by secondary size reduction before they can be removed from the project site. Additionally, some mining methods, such as block caving, have a natural tendency to generate large boulders that must be individually reduced in size on an on-going daily basis. Underground mining operations also confront large slabs or boulders that may cave-in as an undesirable by-product of mined ore-boundaries. These large slabs and boulders must also be dealt with in secondary rock breaking operations.

Three methods are commonly employed in underground operations for secondary size reduction. According to a first method (drill and blast method), a single hole or several holes are drilled in the oversized boulder, explosives are installed in the hole and the boulder is blasted into smaller fragments. A second method employs directional explosives (shaped charges). The directional explosives are simply attached to the rock surface and set off. This method either breaks the rock or, if the rock is stuck in a draw point, brings the rock onto the loading level where it is reduced by the drill and blast method or removed by loading equipment. A third method employs pneumatic or hydraulic impact hammers to split the rock into smaller fragments. This method is very time consuming, requires substantial man hours, and utilizes expensive and heavy equipment.

The use of explosives in the drill and blast method and the shaped charge method present inherent problems. These problems include, the necessity for the evacuation of the mining personnel and equipment from the blast area prior to the blast, the need to schedule the blast, and the requirement that the blast area be ventilated for a period of time before personnel are allowed back into the working area to continue their work. Additionally, the use of explosives requires personnel qualified to handle and work with explosives. Further, the cost of secondary blasting is high relative to the general cost-per-ton mined and the activity is very time consuming per unit volume of rock broken. Also, the use of explosives often causes damage to the surrounding rock and nearby secondary structures. Finally, the use of explosives or shaped charges presents an exceptional safety risk when the work is conducted in conditions where the rock is hanging over-head (so called hang ups).

Oversized boulders are also commonly created in surface mining and quarrying due to inaccurate drilling or charging of blast holes, misfiring of the explosives during the blast, using the wrong explosives and misjudging the hole-pattern planning. Two main methods are commonly employed in surface operations for secondary size reduction. The first method is the drill and blast method discussed above. Surface operations and quarrying also utilize pneumatic and hydraulic impact hammers to split oversized boulders into smaller fragments. These methods present problems similar to those encountered during secondary size reduction in underground operations.

During earth moving and building construction, large rocks which cannot be handled by loading and transport equipment are occasionally hit. These rocks are normally reduced through the use of explosives. As with underground and surface mining, the use of explosives presents a wide range of problems. The use of explosives in earth moving and building construction presents additional problems when the blast is conducted in urban areas, because there is always potential liability from flying rocks and blast vibration damage to surrounding structures and equipment.

The explosive methods for secondary size reduction discussed above may be replaced by non-explosive propellant based techniques. These techniques are safer, but they are highly time consuming due do the manual work required to install the shooting devices, cartridges, and absorbing mats. Current non-explosive techniques are relatively unsafe due to the manual charging of the charging device. U.S. Pat. No. 4,900,092 to Van Der Westhuizen et al. discloses such a propellant based technique.

In addition to dealing effectively with oversized boulder in mining and excavation processes, breaking up and excavating an original mass of rock efficiently is a major mining concern. To this end, numerous developments over the years have been advanced in order to both enhance excavation process rates and create safer work environments. A third important factor in new development efforts has focused on developing technologies and techniques that allow rock excavation processes to be performed on a continuous basis.

A method for rock breaking which satisfies the ability to break very hard rock with energy efficiency and excavate the broken rock on a continuous basis, employs non-explosive propellant based techniques. This method is performed in the following manner: drilling a short hole in a monolithic rock structure, wherein the hole is stepped narrower at the bottom few inches of the hole; inserting the barrel of a military-type cannon into the hole and forcing it to the bottom of the hole to create a mechanical seal by the forward force applied to the gun barrel against the rock shoulder; firing a propellant based cartridge in the barrel of the cannon to pressurize the bottom of the hole and cause a small volume of rock to break out of the massive structure. Alternately, the propellant-based cartridge can be placed on the end of a charging bar and the charging bar can be forced within the hole to place the cartridge at the bottom of the hole. The force of the charging bar against the shoulder of the stepped hole creates a seal. Once the cartridge is properly positioned and the seal is created, the cartridge may be fired and ignited to destroy the rock.

Non-explosive techniques are disclosed in U.S. Pat. Nos. 5,308,149, to Watson et al., and 5,098,163, to Young, III. The techniques disclosed by Watson et al. and Young, III, are relatively safe, but require highly sophisticated, vulnerable and expensive equipment. Additionally, due to the non-standard nature of the propellant cartridges (cartridge cost) these techniques are costly to operate.

As discussed above, prior rock breaking techniques are limited in their effectiveness. Specifically, drill and blast techniques are the most common methods employed, but they are expensive, unsafe, time consuming and hazardous to the surroundings. Directional explosives are also common, but they are not efficient and are unsafe as a result of the explosives involved. Non-explosive propellant based techniques, such as those disclosed in U.S. Pat. No. 4,900,092, are relatively safe, but highly time consuming due to the manual work required to install the shooting device, cartridges, and absorbing mat.

In addition, high pressure water methods (without explosives) require high water pressure and high impulse speed in order to overcome the inherent strength of the rock. Generating sufficient water pressure and impulse speed requires complicated and expensive pump devices and components. Further, high water pressure methods demand extreme water purity standards in order to operate successfully. These devices also have very high maintenance costs associated with their operation, particularly in the dirty and harsh environments of mining, quarrying and construction.

The non-explosive techniques disclosed in U.S. Pat. Nos. 5,308,149 and 5,098,163 are relatively safe, but require highly sophisticated and expensive equipment. Consequently, they are costly to operate. Additionally, these non-explosive techniques present noise problems when misfires occur. The technology also requires a large, heavy, complicated and expensive military-like cannon, which is expensive to maintain. In order to operate these cannon-type rock breaking devices, the following gun components are essential: a strong heavy duty barrel able to withstand the firing shock and stress of falling rocks; a recoil dampening mechanism to protect the gun, its components, and the equipment it is integrated with; and an accurate loading and storage device for the cartridges.

These cannons also create undesirable dangers. Specifically, the cannons are potentially unsafe, since reloading is done closer to the face. Additionally, the gun barrel is in the drill hole within the rock structure and as such is exposed to rock damage after the cartridge is fired. Further, the gun components are large and heavy, and require heavy structures to support the weight and recoil forces associated with the propellant pressure impact. These conditions cause a cumulative demand for heavier non-conventional booms to carry the extra gun components, the heavier booms require heavier non-conventional carriers, all of which result in very high capital costs. In summary, these heavy, large, complicated and expensive systems are severely limited in the applications where they can be employed, and are generally only suitable for large mining or construction applications.

After studying methods and apparatuses currently available for rock breaking operations, it is apparent that a need exists for an efficient, safe, and cost effective method, apparatus and cartridge for rock breaking operations. The present invention provides such a method and apparatus.

SUMMARY OF THE INVENTION

It is, therefore, an object of the present invention to provide a non-explosive rock breaking method. The method is accomplished by first drilling a hole into a rock. An installation tube and nozzle (which are components of the charging system) are then positioned at the hole collar and a propellant cartridge is inserted within a remote charging tube. The propellant cartridge contains a propellant and means for igniting the propellant. Finally, the propellant cartridge is forced through the charging system and into or adjacent, the hole with sufficient force to ignite the propellant.

The cartridge may be forced through the charging system by the use of air or water. In addition, the cartridge may be forced through the charging system by other structures, including, for example, a push rod. The propellant cartridge may be forced into the hole, to the bottom of the hole, or to the end of the charging system. Ignition of the propellant cartridge may be achieved in a variety of manners, including, but not limited to, impact by a liquid pressure pulse, impact against the bottom of the hole, or impact from the force of a push rod.

It is another object of the present invention to provide a propellant cartridge for use in non-explosive rock breaking techniques. The cartridge includes a cartridge enclosure which houses a firing mass and a propellant container. The propellant cartridge further includes means for igniting the propellant when the firing mass is forced into contact with the propellant container.

It is a further object of the present invention to provide an apparatus for non-explosive rock breaking. The apparatus includes a rock drill and a charging system associated with the rock drill, wherein the charging system is adapted to be positioned in proximity to a previously drilled hole. The charging system includes a remote charging tube positioned at the distal end of the charging system, an installation tube positioned at the proximal end of the charging system, and a flexible charging hose connecting the remote charging tube and the installation tube. The apparatus further includes a propellant cartridge adapted to be placed within the remote charging tube and forced through the charging tube and flexible hose to the installation tube where the cartridge enters the hole drilled in the rock and the propellant contained within the cartridge is ignited.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The invention provides a method and apparatus facilitating non-explosive rock breaking in both underground and surface operations. The present invention may also be used for the purpose of breaking concrete structures in demolition work.

Briefly, non-explosive rock breaking performed in accordance with the present invention is accomplished by first drilling a hole in a rock. The charging system is then positioned within the drill hole. Specifically, an installation tube and nozzle of the charging system are positioned at the collar of the drill hole or they may be placed fully or partially inside the drill hole. A propellant cartridge containing a propellant and structure for igniting the propellant is then inserted within a remote charging tube. Finally, the propellant cartridge is forced through the charging system and into the hole with sufficient force to ignite the propellant. The propellant cartridge is ignited in the hole, or close to the hole in the installation tube and nozzle. Ignition of the propellant within the sealed hole creates great gas pressure resulting in the fragmentation of the rock adjacent to the drill hole.

Figure 1:
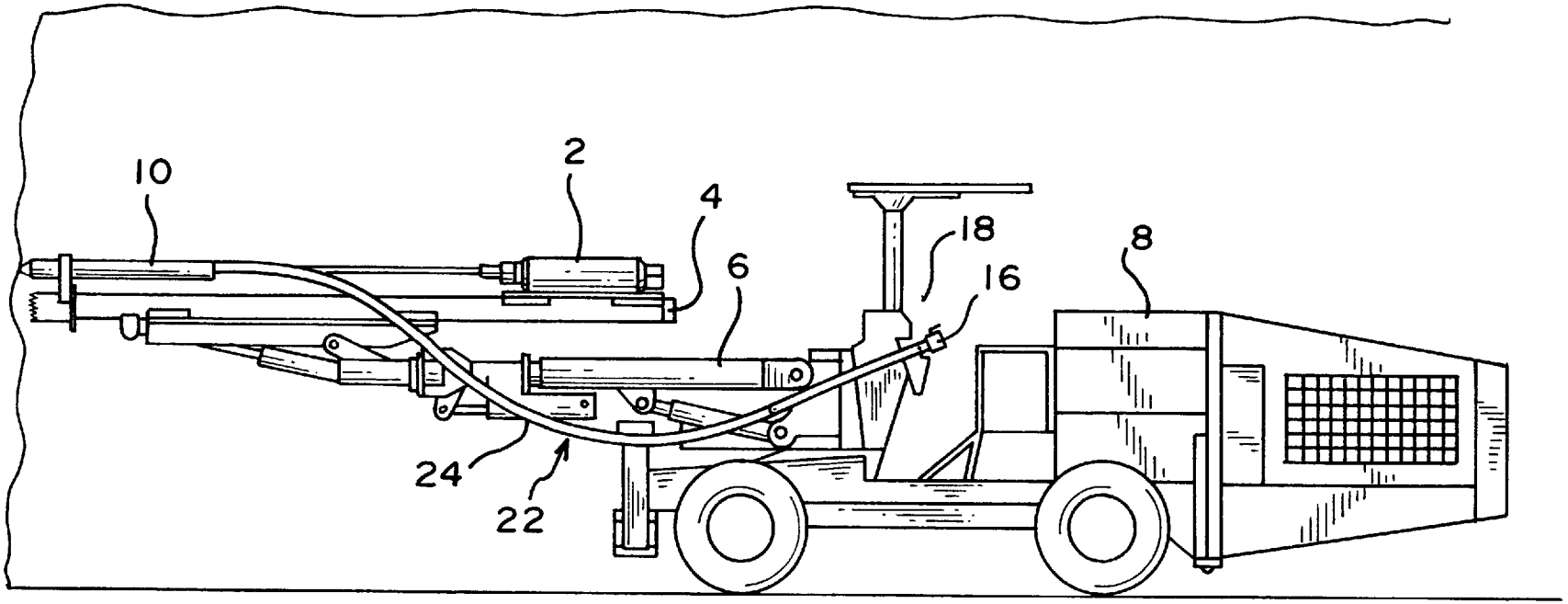
FIG. 1 is a schematic of the rock breaking operation.
Figure 3A:
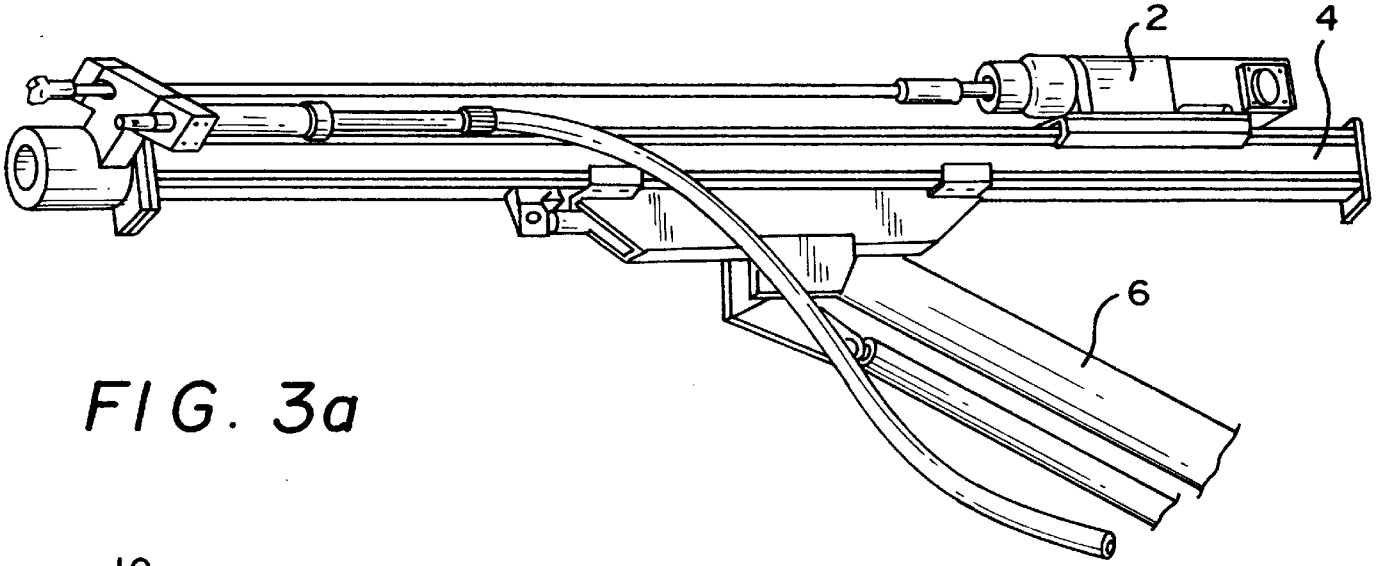
FIG. 3*a* is a schematic of the drilling operation.

With reference to FIG. 1, the present invention is disclosed in greater detail. A hole is first drilled into the rock or boulder. The hole is drilled by a rock drill (2). Movement of the rock drill is controlled by a drill feed (4). Both the rock drill (2) and the drill feed (4) are mounted on a drilling boom (6) which forms part of a drilling carrier (8). All of this equipment is conventional, and can be provided in a variety of forms without departing from the spirit of the present invention (FIG. 1 and FIG. 3*a*).

Figure 2:
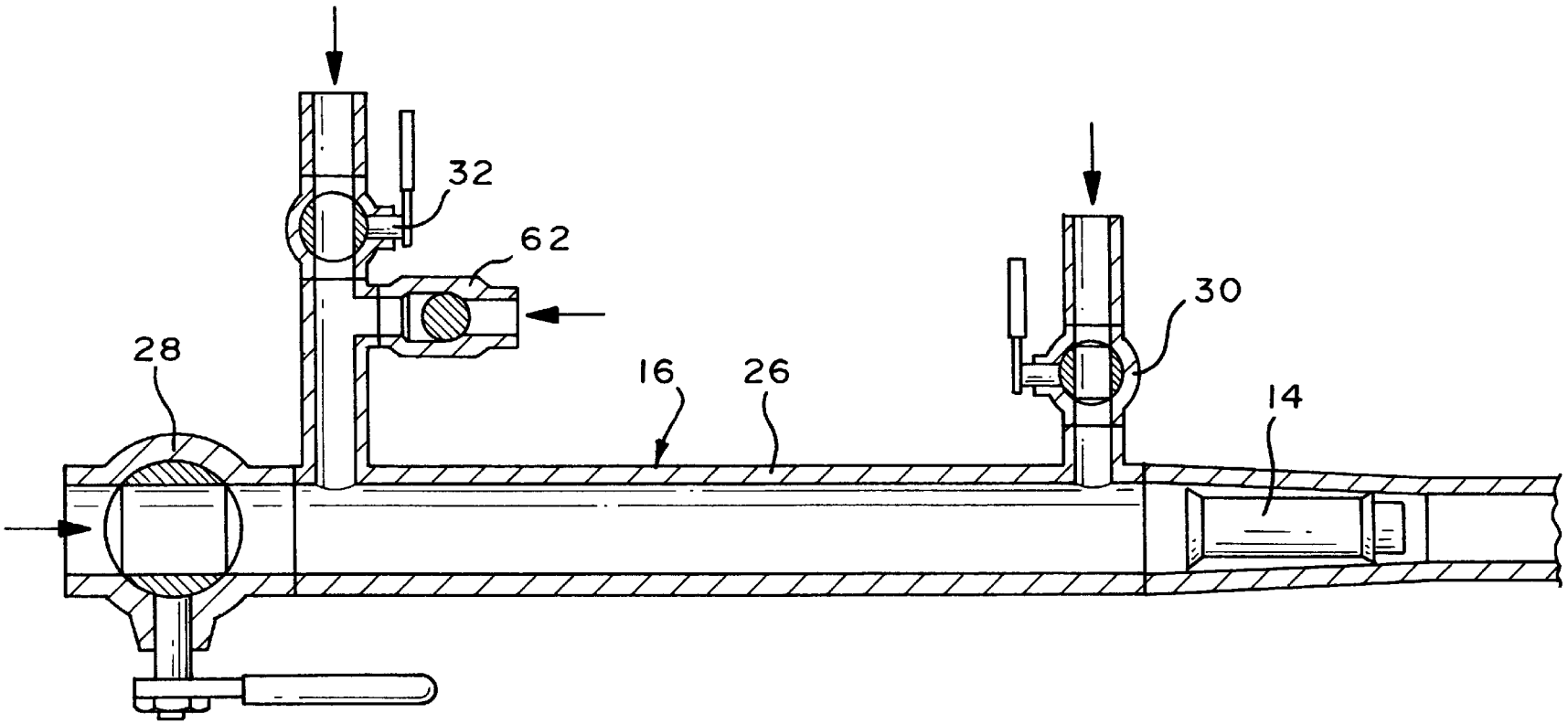
FIG. 2 is a cross sectional view of the remote charging tube.
Figure 3B:
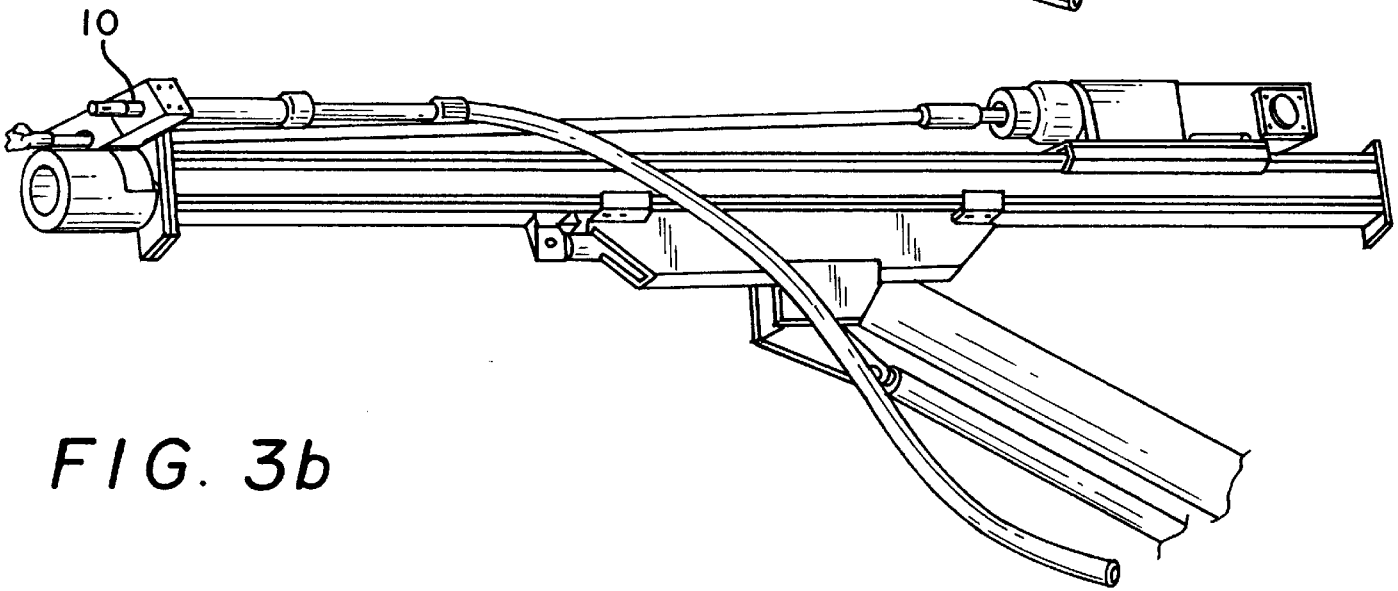
FIG. 3*b* is a schematic of the installation operation.

The installation tube and nozzle (10) is then positioned at the collar of the drill hole (12) (FIGs. 5*a*, 5*b*, 6, 8*a* and 8*b*) and a propellant cartridge (14) (FIGS. 7*a*, 7*b*, 7*c*, 7*d* and 7*e*), containing a firing mass and propellant container, is installed in the remote charging tube (16) (FIG. 2) located on the working platform (18) of the drilling carrier (8). With reference to FIG. 1, the remote charging tube (16) of the charging system (22) is secured to the forward portion of the main body of the drilling carrier (8) and the installation tube and nozzle (10) is secured to the front (proximal) end of the drill feed (4) (FIG. 3*a* and 3*b*). The remote charging tube (16) and the installation tube (10) are attached by a flexible charging hose (24) which extends from the distal end of the remote charging tube (16) to the proximal end of the installation tube and nozzle (10).

The remote charging tube (16) includes a cylindrical main body (26) sized to receive a propellant cartridge (14) that will be discussed in greater detail below. The main body (26) includes a main valve (28) which is opened to insert the propellant cartridge within the remote charging tube (16). The main body (26) also includes a liquid feed valve (30) and a fluid feed valve (32), the functions of which will be discussed in greater detail below.

As stated previously, the propellant cartridge (14) is inserted within the charging system (22). This is accomplished by first opening the main valve (28) and placing the propellant cartridge (14) into the main body (26) of the remote charging tube (16). The propellant cartridge (14) then migrates to the forward end of the remote charging tube (16).

A liquid, preferably water, is then fed into the remote charging tube (16) through the liquid feed valve (30) until the liquid overflows through the main valve (28). This creates a liquid column. The main valve (28) and the liquid feed valve (30) are then closed. The fluid feed valve (32) is then opened and a transport fluid medium, preferably air or water, is applied to pressurize the water column behind the propellant cartridge (14). The transport fluid medium forces the liquid column and the propellant cartridge (14) from the remote charging tube (16) to the bottom of the drill hole (12) with sufficient force or liquid pressure increase to cause the firing mass to slide forward within the propellant cartridge (12) and strike the propellant container. This causes ignition of the propellant, development of gas pressure, and fragmentation of the rock adjacent to the drill hole. It should be understood that the impact causing the propellant to ignite may be from any external force, including, but not limited to, impact with the drill hole, a fluid pressure pulse, contact with a push rod, etc.

The liquid positioned around, between and behind the propellant cartridge (14) enhances the gas pressure capacity to break the rock when the propellant within the propellant cartridge ignites. Specifically, the mass and velocity of the liquid act against the blast pressure to improve the overall efficiency of the present invention.

As discussed above, a propellant cartridge (14) is passed through the charging system (22) to the hole (12), where the force of impact or the force from liquid pressure increase causes propellant contained within the propellant cartridge (14) to ignite. Ignition of the propellant causes pressure, resulting in the fragmentation of the rock. Possible forms of the structure of the propellant cartridge (14) are shown in FIGS. 7*a*, 7*b*, 7*c*, 7*d* and 7*e*.

Figure 7A:
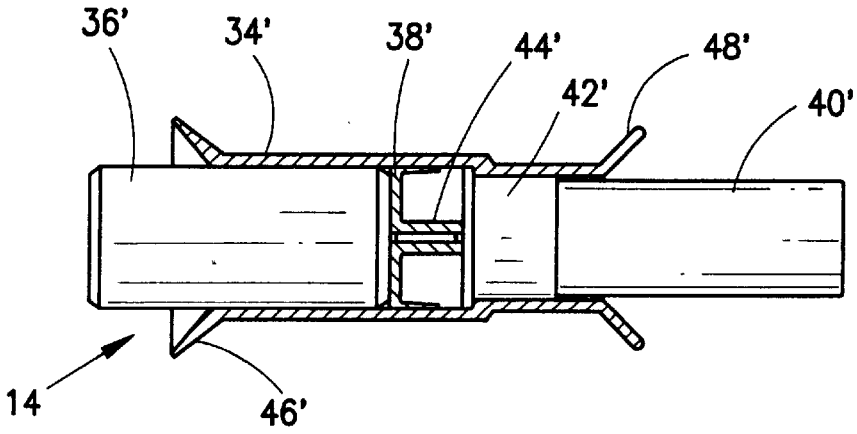
FIG. 7*a* is a cross sectional view of the propellant cartridge.
Figure 7B:
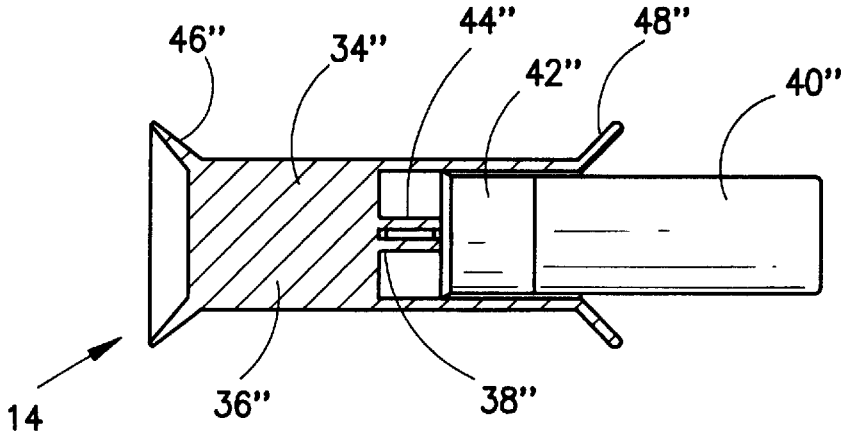
FIG. 7*b* is a cross sectional view of an alternate embodiment of the propellant cartridge.

The propellant cartridges (14', 14") disclosed in FIGS. 7*a* and 7*b* each include a cartridge enclosure (34', 34") housing a firing mass (36', 36"), a molded safety pin enclosure (38', 38"), and a propellant container (40', 40"). With regard to the propellant container (40', 40"), it is preferably a simple small barrel filled with a solid or liquid propellant. It should be noted that a variety of propellants may be used without departing from the spirit of the present invention. The propellant container (40', 40") is further provided with an ignition primer (42', 42") located at the distal end of the propellant container (40', 40") adjacent to the firing pin (44', 44") of the firing mass (36', 36"). The primer (42', 42") is preferably a #3 primer, although other primers could be used without departing from the spirit of the present invention.

As to the firing mass, the body is made from any heavy piece of solid material, such as, steel, aluminum, wood, plastic, etc. Additionally, the shape and weight of the firing mass can be varied to suit specific applications. With regard to the structure of the firing mass, it can be a separate cylindrical mass (36') (see FIG. 7*a*) or the firing mass (36") can be integrated with the cartridge enclosure (34") (see FIG. 7*b*). A firing pin (44', 44") is incorporated into a separate molded pin enclosure (38', 38") for safety against premature ignition. In use, impact of the propellant cartridge enclosure with the drill hole or a liquid pressure increase (for example, a liquid pressure pulse) causes the firing mass to move forward and/or the propellant container to move backward such that the molded firing pin enclosure flexes or fatigues and allows the firing pin to move forward and strike the ignition primer of the propellant container. This causes the primer to fire and the propellant to ignite.

The cartridge enclosure (34', 34") further includes an annular integrated seal (46', 46") incorporated in the distal end of the cartridge enclosure (34', 34"). As shown in both FIGS. 7*a* and 7*b*, the integrated seal (46', 46") end of the cartridge enclosure (34', 34") is designed to be slightly larger than the diameter of the charging hose (24) and possibly the drill hole (12). This arrangement exposes the seal (46', 46") to the pressures applied by the transport fluid medium, which propels the propellant cartridge (14) through the charging system (22). In fact, the seal (46', 46") maintains the transport fluid medium behind the propellant cartridge (14) and prevents the transport fluid medium from leaking around the propellant cartridge (14) when the propellant cartridge (14) is installed within the charging system or forced through the charging system (22). The proximal end of the cartridge enclosure (34', 34") incorporates an integrated parachute (48', 48") with wings slightly larger than the diameter of the charging system (22) and possibly the drill hole (12). The parachute (48', 48") keeps the propellant cartridge (14) centered in the charging system and drill hole during its transport through the system. The parachute (48', 48") may also expand upon impact and works as a pressure seal when the propellant ignites to produce gas pressure.

Specifically, the liquid column and transport fluid medium apply pressure to the seal, forcing the propellant cartridge through the charging system toward the drill hole. The seal provides another function when the propellant cartridge impacts the drill hole. The seal can be made slightly larger than the drill hole or made to become larger due to the impact forces and/or pressure forces created by cartridge insertion and/or propellant ignition. In this way, the seal with the water column behind the seal creates an effective pressure seal by lodging against the walls of the drill hole. As a result, the forces created by the ignition of the propellant are sealed within the drill hole; that is, the seal creates a back pressure containing the pressure pulse from the ignited propellant within the hole and maximizes the amount of energy utilized in the fragmentation of the rock. This enhances the effectiveness of the rock destruction process.

As stated previously, safe use of the present invention is enhanced by the provision of the molded safety pin enclosure (38', 38"). The molded pin enclosure (38', 38") is positioned between the firing mass (36', 36") and the propellant container (40', 40"), and prevents undesired premature contact between the ignition primer (42', 42") and the firing pin (44', 44"). The molded pin enclosure (38', 38"1) will break or fatigue due to the impact against the hole bottom or the liquid pressure pulses and allow the firing pin to penetrate into the primer and ignite the propellant.

The cartridge enclosure is preferably a small cylindrical tube made from conventional hard plastics. The middle section holds the firing mass propellant container and molded pin enclosure (safety device). This middle section is designed with a slightly smaller diameter than the firing mass and propellant container, such that the firing mass and the propellant container are securely and safely separated and retained within the cartridge enclosure. Consequently, the cartridge enclosure or propellant container must be impacted with sufficient force (for example, by contact with the drill hole or a liquid pressure increase), before the firing pin (44', 44") can penetrate the primer (42', 42") to facilitate the ignition of the propellant. In fact, the cartridge enclosure (34', 34") is designed to ignite only after it has been impacted with sufficient force caused by, for example, hitting the bottom of the hole or the application of a liquid pressure increase. The shape of the enclosure keeps the critical components, the firing mass, the propellant container, the primer, and the firing pin, axially centered in the remote charging tube, charging hose, installation tube and nozzle, and fully protected from outside impact forces such as uneven surfaces, burs, shoulders and the like as it moves through the installation system. This prevents inadvertent ignition of the propellant. While the design of the cartridge enclosure must protect the essential components of the propellant cartridge, it can be manufactured in a variety of shapes and from a variety of materials without departing from the spirit of the present invention. Several different propellant cartridge designs can be employed. In its most simplified form, the enclosure itself contains an integrated firing mass and pin. The enclosure is also shaped such that it incorporates the seal.

The gas pressure capacity produced by the ignition of the propellant is optimized in the present invention by positioning the propellant container (40', 40") with about a third of its total length outside of the cartridge enclosure (34', 34"). This keeps the cartridge enclosure (34', 34") plastic behind the expanded gas produced by the propellant at impact. As a result, plastic from the cartridge enclosure (34', 34") is kept away from the bottom of the drill hole, any sealing effect the plastic might have at hole bottom is prevented, and reductions in rock breakage efficiency are limited.

Figure 7C:
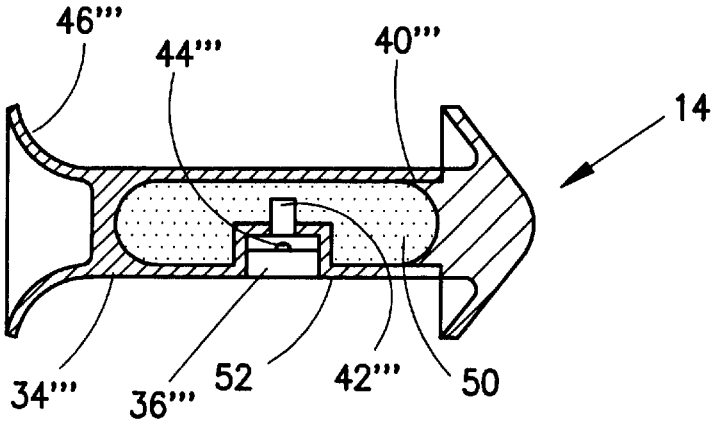
FIG. 7*c* is a cross sectional view of a further alternate embodiment of the propellant cartridge.
Figure 7D:
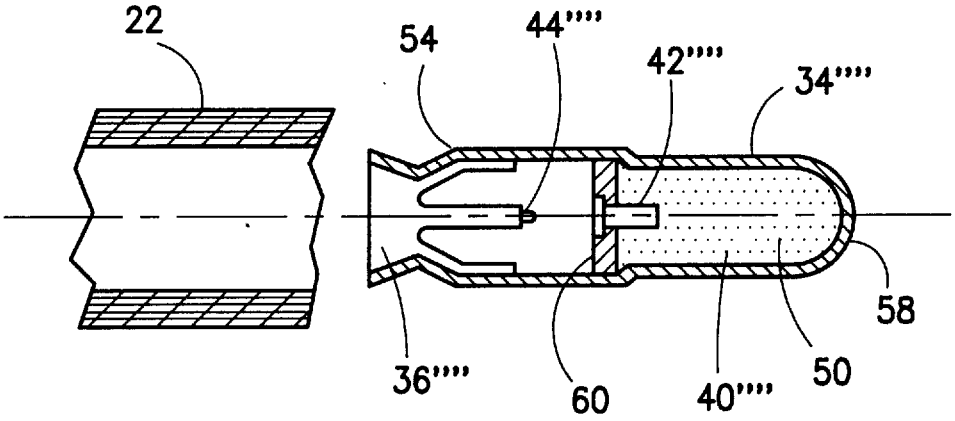
FIGS. 7*d* and 7*e* are cross sectional views of another alternate embodiment of the propellant cartridge.
Figure 7E:
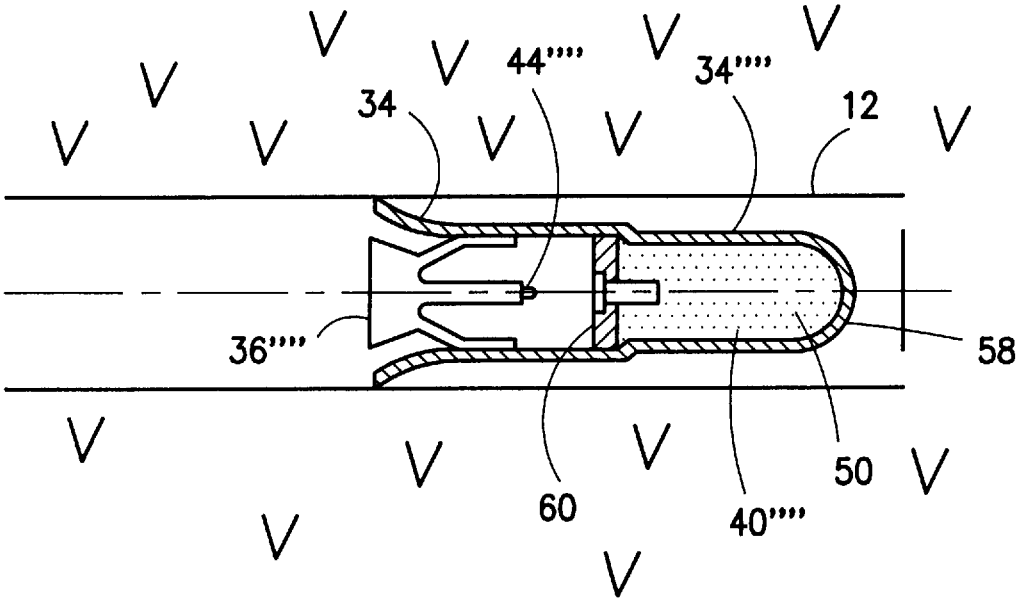

Alternate propellant cartridges are disclosed in FIGS. 7*c*, 7*d* and 7*e*. With regard to the propellant cartridge disclosed in FIG. 7*d*, the propellant cartridge (14) includes a propellant container (40''') integrally formed with the cartridge enclosure (34'''). The propellant container (40''') has a space defined therein for housing a solid or liquid propellant (50). A recess (52) is provided in the body of the cartridge enclosure (34'''). The recess houses the firing mass (36'''), the firing pin (44''') and the ignition primer (42'''). Specifically, the ignition primer (42''') is located substantially within the space defined within the propellant container (40''') and the firing mass (36''') is located within the recess (52), adjacent the ignition primer (42'''). The firing pin (44''') is oriented such that it extends from the firing mass (36''') toward the ignition primer (42''').

The present propellant cartridge permits firing of a propellant cartridge without the need for collapsing the cartridge enclosure (34'''). Specifically, pressure pulses within the charging system cause the firing mass (36''',) to move toward the ignition primer (42'''), causing the firing pin (44''') to contact the ignition primer (42''') and ignite the propellant (50).

As with the embodiments shown in FIGS. 7*a* and 7*b*, this embodiment is provided with an annular integrated seal (46''') at the end of the propellant cartridge (14). As discussed previously, the integrated seal is slightly larger than the diameter of the charging hose, and may be advantageously employed in the firing procedure.

The propellant cartridge disclosed in FIGS. 7*d* and 7*e* includes a cartridge enclosure (34"") having a resiliently flexible rear end (54). The cartridge enclosure includes an integrally formed propellant container (40"") at its forward end housing a solid or liquid propellant (50). The propellant container (40"") is defined by the forward end (58) of the cartridge enclosure (34"") and a wall (60) formed at a midpoint within the cartridge enclosure (34""). The wall (60) supports an ignition primer (42"") that is used to ignite the propellant (50) in a manner that will be discussed in greater detail.

The propellant cartridge is further provided with a firing mass (36"") supporting a firing pin (44""). The firing mass (36"") is shaped to conform with the rear end (54) of the cartridge enclosure (34"") when the cartridge enclosure (34"") is in its compressed configuration as shown in FIG. 7*d*. In this way, the firing mass (36"") is prevented from moving within the cartridge enclosure (34""). However, the rear end (54) of the cartridge enclosure (34"") is only held in this compressed configuration when it is positioned within the charging system (22). As a result, when the propellant cartridge (14) enters the drill hole (12), which has a larger diameter than the charging system (22), the rear end (54) of the cartridge enclosure (34"") opens and releases the firing mass (36""). The firing mass (36") is then permitted to move forward such that the firing pin (44"") strikes the ignition primer (42"") to ignite the propellant (50).

The present invention provides a method, apparatus and cartridge for non-explosive rock fragmentation having many advantages over previously known techniques. For example, the cartridge can be loaded within the charging hose while the hole is drilled and the loading can be accomplished at a location remote from the rock. Additionally, the use of non-explosive propellant cartridges does not require trained and licensed personnel, the cartridge is compact and incorporates all items and features necessary to break rock, the holes for rock can be drilled at any angle and spatial orientation, the operation is remotely operated, propellant gas products do not require excessive ventilation, the energy produced in the fired propellant is used in generating and expanding existing fractures in the rock and produces no flying rocks and limited dust (due to the water involved in the process), and rock may be broken at any time and in any place without concern for structural and environmental damage.

An alternate charging system and associated method for rock breaking are disclosed in FIGS. 4, 5*a*, 5*b*, 6. In accordance with this embodiment, the charging system (22) includes a remote charging tube (16), and a charging hose (24) connecting the remote installation tube and the nozzle (10) as discussed previously. As with the prior embodiment, the remote charging tube (16) includes an opening for the positioning a cartridge within the charging system (22). The remote charging tube also includes a charge-in valve (62) permitting the application of increased water pressure to ignite the cartridge (14) in a manner that will be discussed in greater detail.

The charging system (22) is used in the following manner. First, the charging hose (24) is emptied by forcing air through the remote charging tube (16). The installation tube and nozzle (10) is then positioned on the collar of the drill hole (12). A cartridge (14) is place within the remote charging tube (16) and the main valve (28) is closed. Next, a feed liquid is supplied to the remote charging tube (16), behind the cartridge (14), to force the cartridge (14) into the drill hole. When water begins spilling out of the hole, the cartridge (14) should be within the drill hole. Finally, the water pressure is increased in the charging system by a pressure increase apparatus as shown in FIGS. 4, 5*a*, 5*b*, and 6 that will be discussed below in greater detail. The increased water pressure forces the firing pin within the ignition primer to ignite the propellant with the cartridge.

Alternately, the charging system (22) could be used by first emptying the charging system (22) in the manner discussed above. Then the installation tube and nozzle (10) is placed within the drill hole (12). Water is used to force a cartridge (14) to the dill hole in the manner previously discussed. The nozzle and the installation tube (10) can be located fully or partially in the hole or only on the collar of the hole (see FIGS. 5*a*, 5*b* and 6). Finally, the water pressure is increased in the charging system (22) by a pressure increase apparatus. The increased water pressure will force the firing pin within the primer to ignite the propellant with the cartridge.

Figure 4:
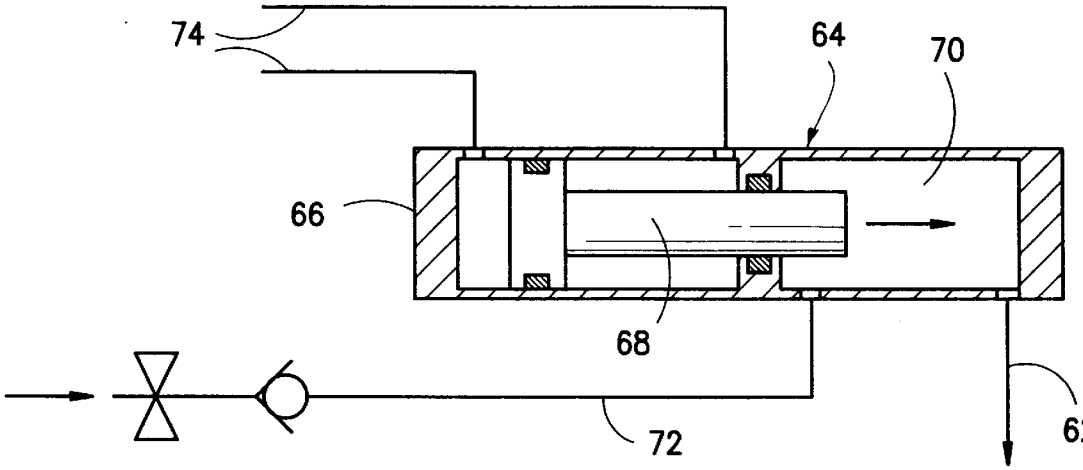
FIG. 4 is cross sectional view of one form of a pressure increase apparatus.

Increased water pressure can be applied to the charging system in a variety of manners. As shown in FIG. 4, a first pressure increase apparatus (64) is disclosed. The pressure increase apparatus includes a hydraulic cylinder bore (66) housing a hydraulic cylinder piston and rod (68). The rod extends into a water cylinder (70) which forces pressurized water to the charge-in valve (62) on the remote charging tube (16) to increase the water pressure within the charging system (22). Water is maintained in the water cylinder (70) by a water supply line (72). In use, oil is selectively supplied to the hydraulic cylinder bore (66) via hydraulic cylinder operating oil lines (74). The oil causes the piston and rod to move and forces pressurized water from the water cylinder (70). While the embodiments disclosed herein utilize hydraulic cylinders, other structures, such as pneumatic cylinders or nitrogen gas cylinders, could be used without departing from the spirit of the present invention.

Figure 5A:
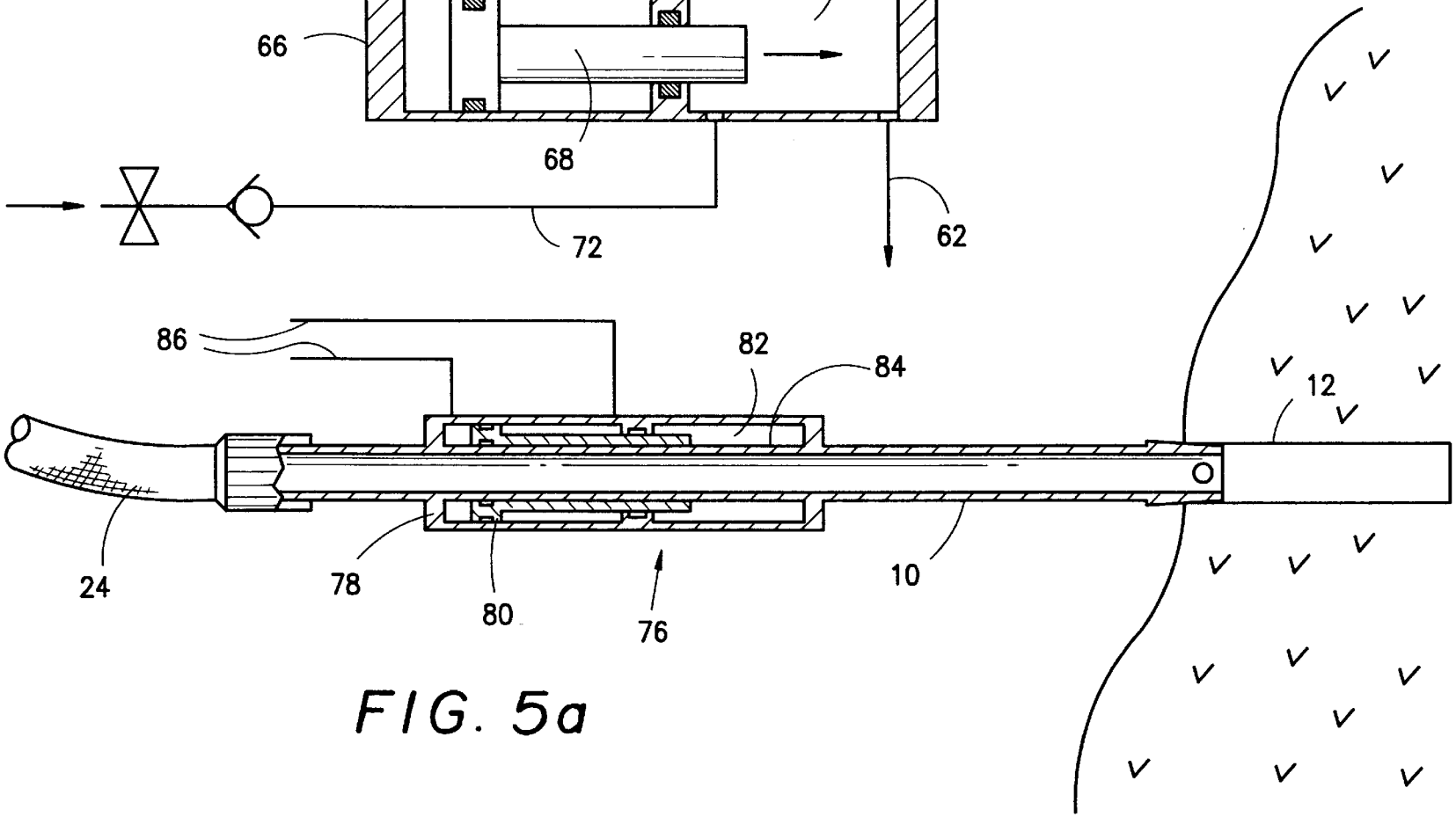
FIG. 5*a* is a cross sectional view of another form of a pressure increase apparatus.
Figure 5B:
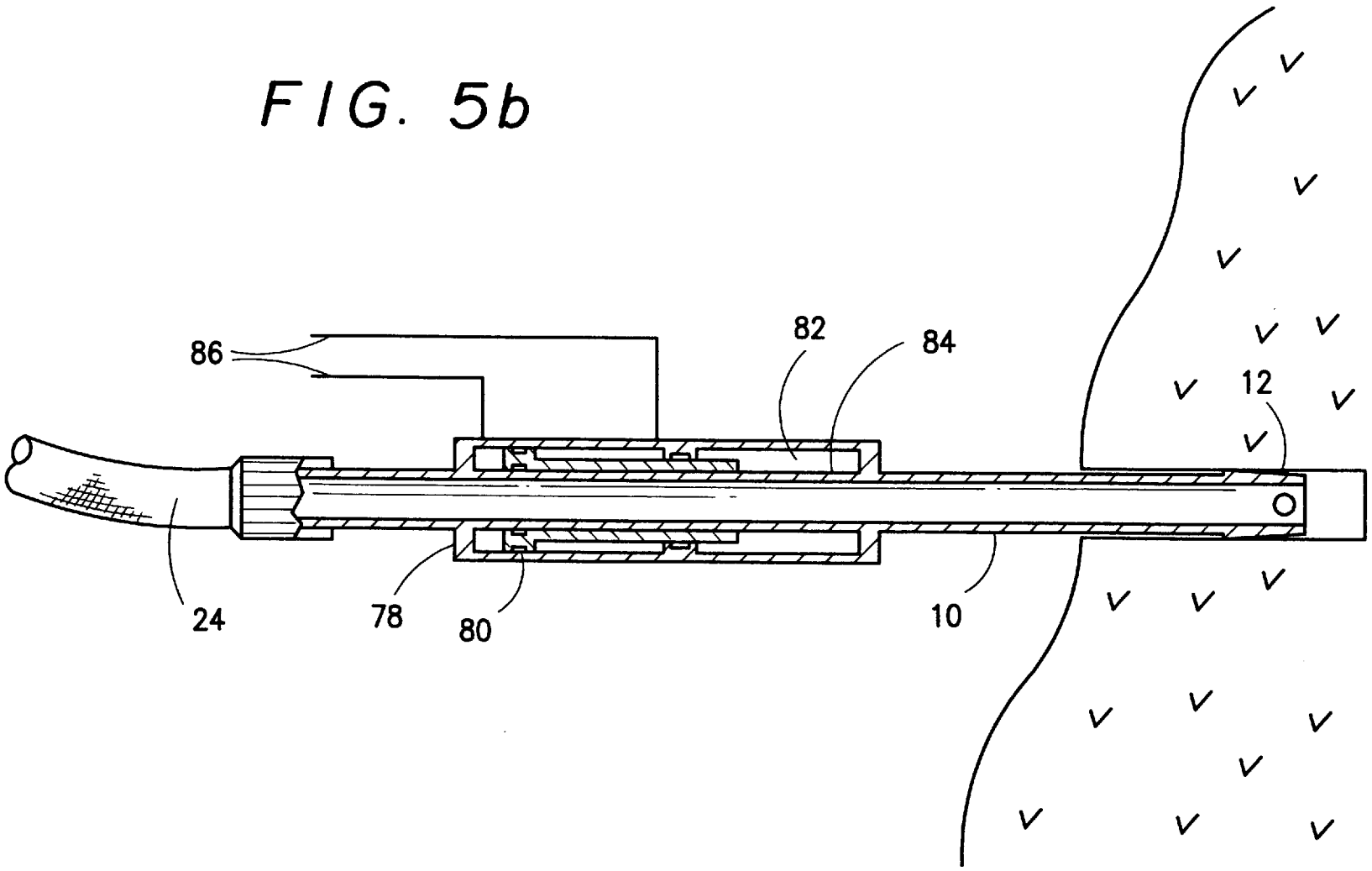
FIG. 5*b* is a cross sectional view of another form of a pressure increase apparatus with the installation tube located in a drill hole.

A second pressure increase apparatus is disclosed in FIGS. 5*a* and 5*b*. The pressure increase apparatus (76) includes a hydraulic cylinder bore (78) positioned about the charging system (22). A hydraulic piston and rod (80) are housed within the hydraulic cylinder bore (78) and extend about the charging system (22). The rod (80) extends into a water cylinder (82) which is in fluid communication with the charging system (22) via openings (84). As with the first pressure increase apparatus (64), the hydraulic piston and rod (80) are actuated within the hydraulic cylinder bore (78) by a fluid media supplied by hydraulic cylinder operating oil lines (86). Accordingly, by extending the hydraulic cylinder piston and rod (80) from the hydraulic cylinder bore (78), pressurized water is forced out from the water cylinder (82) to boost the water pressure in the charging system (22).

Figure 6:
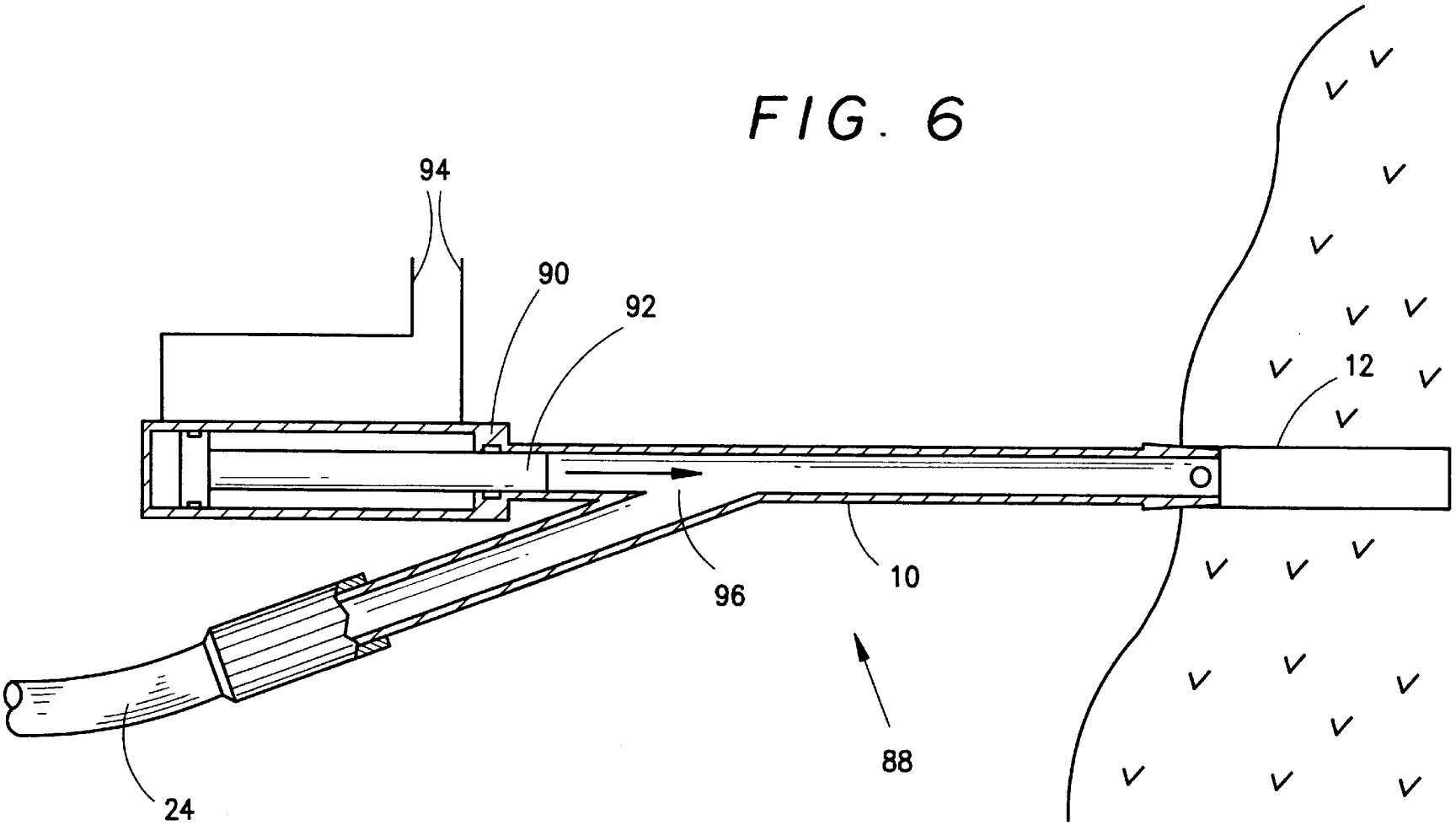
FIG. 6 is a cross sectional view of third form of pressure increase apparatus.

A third pressure increase apparatus (88) is disclosed in FIG. 6 and includes a hydraulic cylinder bore (90) in fluid communication with the charging system (22) adjacent the installation tube and nozzle (10). The hydraulic cylinder bore (90) houses a hydraulic cylinder piston and rod (92). As with the prior embodiments, the hydraulic cylinder piston and rod (92) are actuated by oil supplied via hydraulic cylinder operating oil lines (94). In use, the hydraulic cylinder piston and rod (92) are extended from the cylinder bore (90) to the installation tube (10) to reduce its volume in order to increase the water pressure within the charging system (22). The rod (92) is designed to extend past the opening for the cartridge feed (96) in the installation tube (10) to close the opening at the final stages of pressurization.

Additionally, the hydraulic cylinder bore (90) and the hydraulic cylinder piston and rod (92) act as a shock absorber when the propellant ignites and water attempts to escape back up the charging hose (24) due to the sudden pressure increase caused by the gas pressure.

A fourth pressure increase apparatus can simply be a commercially very common high pressure washer, used for washing cars, etc.

Figure 8A:
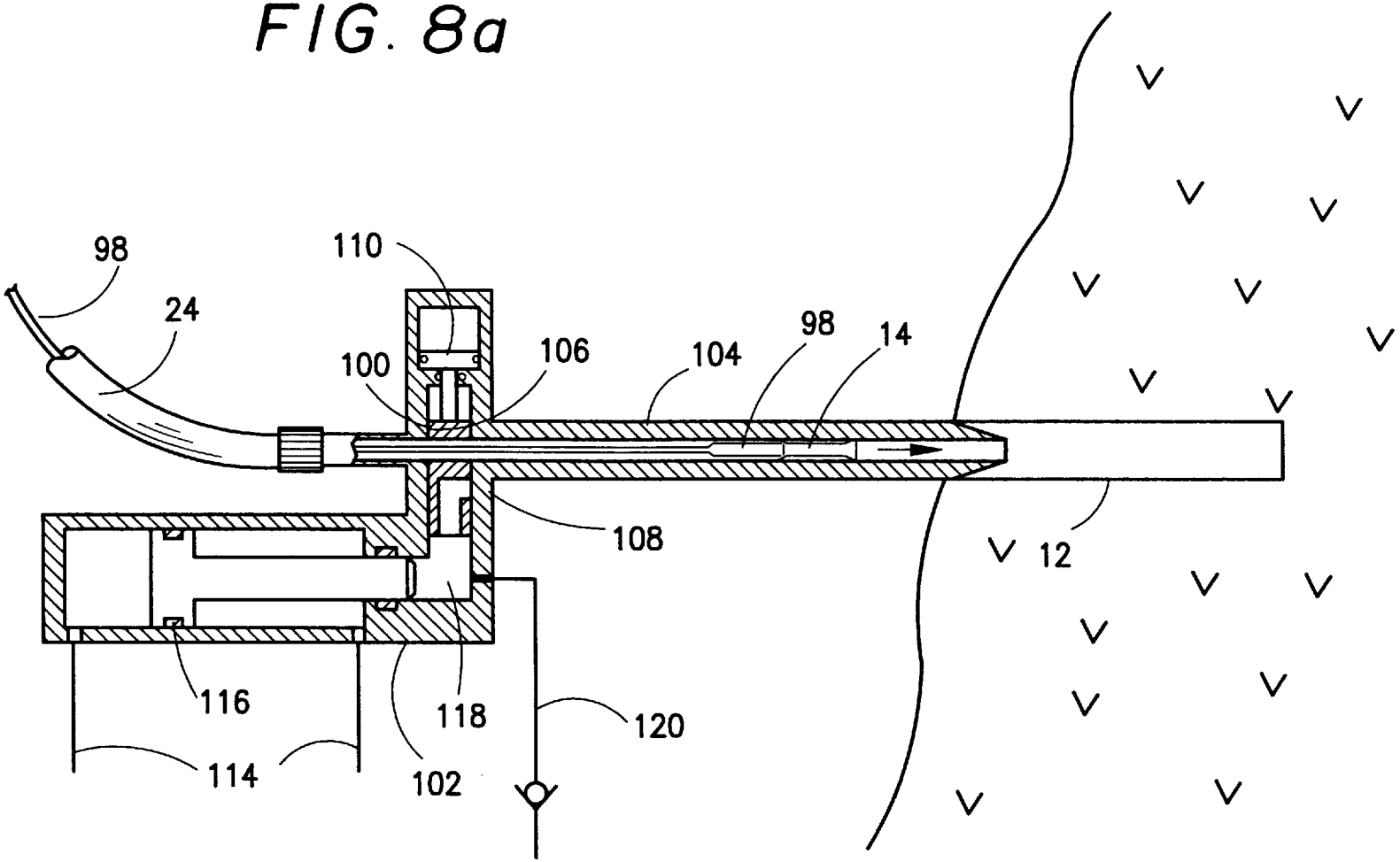
FIGS. 8*a* and 8*b* are cross sectional views showing an alternate delivery and ignition system in accordance with the present invention.
Figure 8B:
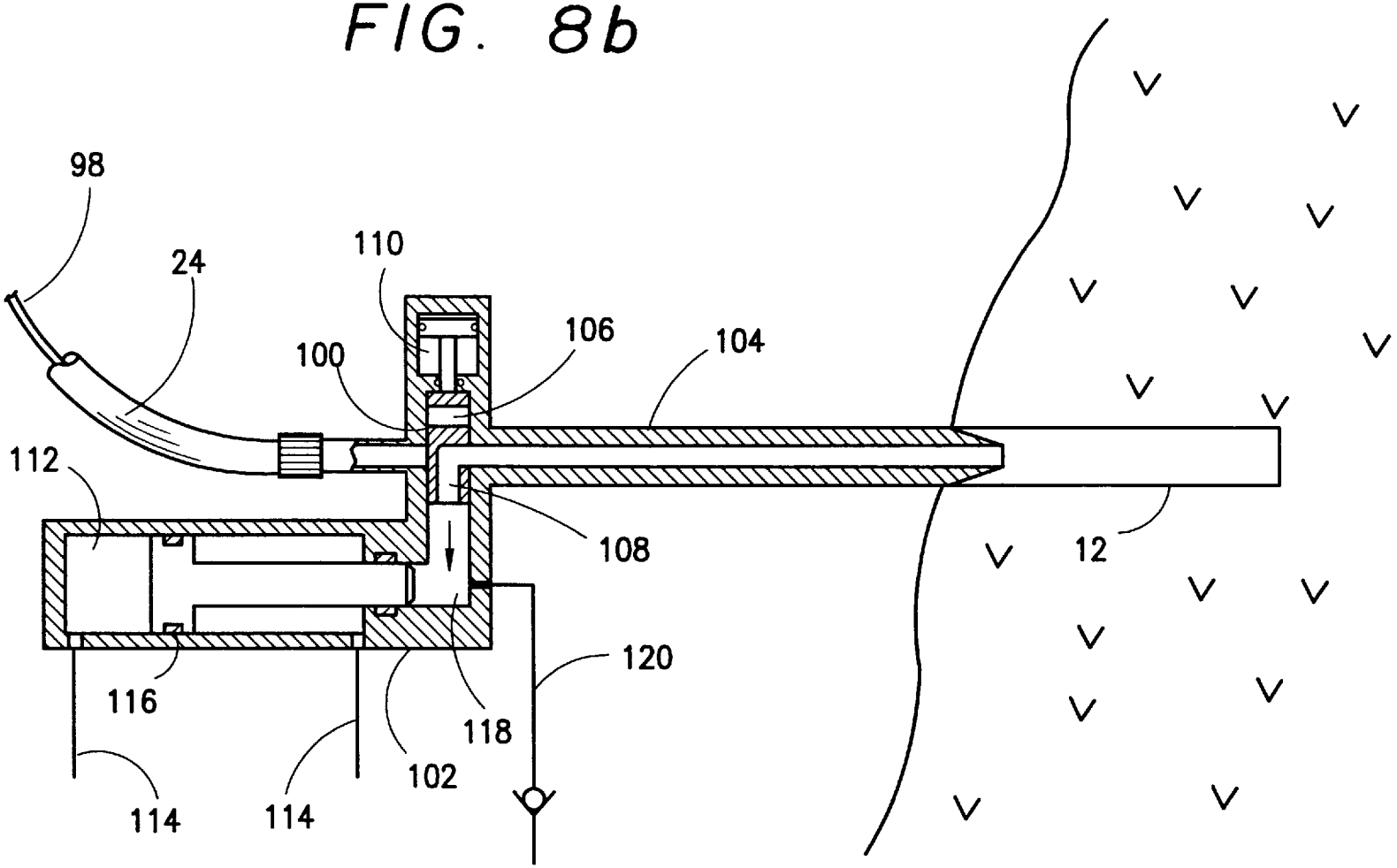

With reference to FIGS. 8*a* and 8*b*, the propellant cartridge (14) may be delivered to the drill hole (12) with the aid of a push rod (98). Accordingly, fluid pressure is not utilized to force the propellant cartridge (14) through the charging system (22) and this is considered to be a dry delivery.

In accordance with this embodiment, a propellant cartridge (14) is inserted within the charging tube (16). The propellant cartridge (14) is then pushed through the charging tube (16), the charging hose (24), the delivery valve (100) of the pressure increase apparatus (102), and the installation tube and nozzle (104) until it is properly positioned in the drill hole (12) or adjacent the drill hole (12). The pressure increase apparatus (102) is formed integrally with the installation tube and nozzle (104) for reasons that will become apparent from the following description.

The pressure increase apparatus (102) includes a delivery valve (100) having a first passage (106) permitting fluid communication between the charging hose (24) and the installation tube and nozzle (104), while preventing pressurization via the pressure increase apparatus (102). The delivery valve (100) also includes a second passage (108) permitting pressurized fluid to be applied within the installation tube and nozzle (104), while sealing the charging hose (24) from the installation tube and nozzle (104). In use, the delivery valve (100) is moved between a first position in which the first passage (106) is aligned with the installation tube and nozzle (104) (see FIG. 8*a*) and a second position in which the second passage (108) is aligned with the installation tube and nozzle (104) (see FIG. 8*b*). A hydraulically or pneumatically controlled piston (110) moves the delivery valve (100) between its first and second positions.

Once the propellant cartridge (14) is properly positioned within, or adjacent, the drill hole (12), the push rod (98) is removed and the delivery valve (100) is moved to its second position. The pressure increase apparatus (102) is then used to ignite the propellant. Specifically, oil is supplied to the hydraulic cylinder bore (112) via hydraulic cylinder operating oil lines (114) in a manner causing the hydraulic cylinder and piston rod (116) to move forward. Forward movement of the cylinder and piston rod (116) forces pressurized water from the water cylinder (118), through the second passage (108) in the delivery valve (100) and into the drill hole (12). The pressurized water causes the propellant cartridge (14) to ignite in a manner discussed in greater detail above.

After the cylinder and piston rod (116) have been moved forward to increase pressure within the charging system (22), the cylinder and piston rod (116) are returned to their original position by applying oil via the hydraulic cylinder operating oil lines (114) in a manner causing the cylinder and piston rod to move rearwardly. Additional water is supplied to the water cylinder (118) as needed by a water supply line (120) in fluid communication with the water cylinder (118).

It should be understood that the shape of the propellant cartridge, that is, its wings and pressure seals, causes the propellant cartridge to remain properly positioned within the drill hole until pressure is applied to ignite the propellant cartridge. This permits accurate and controlled ignition of the propellant.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A non-explosive rock breaking method, comprising the following steps:

drilling a hole into a rock;

positioning a charging system in proximity to the hole;

inserting a propellant cartridge within the charging system, the propellant cartridge containing a propellant and means for igniting the propellant;

forcing the propellant cartridge through the charging system and into the hole, wherein the propellant cartridge is forced through the charging system by a push rod; and igniting the propellant.

2. A propellant cartridge for use in non-explosive rock breaking techniques, comprising:

a cartridge enclosure housing a firing mass and a propellant container;

the propellant container including a housing and a propellant stored within the housing; and means for igniting the propellant when the firing mass is forced into contact with the container.

3. The cartridge according to claim 2, wherein the cartridge enclosure includes a distal end and a proximal end, and the firing mass is positioned at the distal end of the cartridge enclosure and the propellant container is positioned at the proximal end of the cartridge enclosure.

4. The cartridge according to claim 3, wherein the distal end of the cartridge enclosure is flexible and releases the firing mass at a predetermined location to permit the firing mass to contact the propellant container and ignite the propellant.

5. The cartridge according to claim 2, wherein the firing mass is positioned in a recess formed in the body of the cartridge enclosure such that the firing mass will contact the propellant container when a pressure pulse is applied to the propellant cartridge.

6. The cartridge according to claim 5, wherein the recess is formed along a central portion of the body of the cartridge enclosure.

7. The cartridge according claim 2, wherein the means for igniting includes a firing pin on the firing mass and a primer on the propellant container.

8. The cartridge according claim 2, wherein the cartridge enclosure includes a safety pin enclosure positioned between the firing mass and the propellant container.

9. The cartridge according claim 2, wherein the cartridge enclosure is shaped to prevent premature contact between the firing mass and the propellant container.

10. The cartridge according claim 2, wherein the cartridge enclosure includes a proximal parachute and a distal seal connected by a cylindrical central section.

11. The cartridge according claim 2, wherein the cartridge enclosure includes a seal adjacent its distal end.

12. The cartridge according to claim 2, wherein the firing mass is integrally formed with the cartridge enclosure.

13. An apparatus for non-explosive rock breaking, comprising:

a rock drill;

a charging system associated with the rock drill and adapted to be positioned in working proximity to a previously drilled hole, the charging system including a remote charging tube positioned at the distal end of the charging system and a installation tube and nozzle positioned at the proximal end of the charging system, the charging system further including a flexible hose connecting the remote charging tube and the installation tube and nozzle; and a propellant cartridge adapted to be placed within the remote charging tube and forced through the charging system to the installation tube and nozzle, and into the drill hole where propellant contained within the cartridge is ignited, wherein the propellant cartridge includes a cartridge enclosure housing a firing mass and a propellant container.

14. The apparatus according to claim 13, wherein the propellant container includes a housing and a propellant stored within the housing.

15. The apparatus according to claim 14, further including means for igniting the propellant when the firing mass is forced into contact with propellant container.

16. The apparatus according to claim 15, wherein the means for igniting includes a firing pin on the firing mass and a primer on the propellant container.

17. The apparatus according to claim 15, wherein the cartridge enclosure includes a safety pin enclosure positioned between the firing mass and the propellant container.

18. The apparatus according to claim 15, wherein the cartridge enclosure includes a proximal parachute and a distal seal connected by a cylindrical central section.

19. The apparatus according to claim 15, wherein the means for igniting causes the propellant to ignite when the propellant cartridge strikes the drill hole.

20. The apparatus according to claim 19, wherein the charging system includes means for forcing the propellant cartridge through the charging system with sufficient force to cause the ignition of the propellant contained within the propellant container.

21. The apparatus according to claim 15, wherein the means for igniting causes the propellant to ignite when the propellant cartridge is subjected to applied pressure.

* * * * *